US007239291B2

(12) United States Patent
Walton

(10) Patent No.: US 7,239,291 B2
(45) Date of Patent: Jul. 3, 2007

(54) MULTI-BAND ANTENNA

(75) Inventor: Eric K. Walton, Columbus, OH (US)

(73) Assignee: The Ohio State University Research Foundation, Columbus, OH (US)

( * ) Notice: Subject to any disclaimer, the term of this patent is extended or adjusted under 35 U.S.C. 154(b) by 40 days.

(21) Appl. No.: 11/325,365

(22) Filed: Jan. 4, 2006

(65) Prior Publication Data

US 2006/0232479 A1 Oct. 19, 2006

Related U.S. Application Data

(60) Provisional application No. 60/641,403, filed on Jan. 5, 2005, provisional application No. 60/704,588, filed on Aug. 2, 2005.

(51) Int. Cl.
*H01Q 15/02* (2006.01)

(52) U.S. Cl. ..... 343/909; 343/700 MS

(58) Field of Classification Search ..... 343/909, 343/700 MS, 756, 846
See application file for complete search history.

(56) References Cited

U.S. PATENT DOCUMENTS 5,160,936 A 11/1992 Braun et al.
5,485,167 A 1/1996 Wong et al.
5,949,387 A 9/1999 Wu et al.
5,982,339 A 11/1999 Lalezari et al.
6,121,931 A * 9/2000 Levi ..... 343/700 MS
6,452,549 B1 9/2002 Lo
6,608,607 B2 8/2003 Wu
6,747,608 B2 6/2004 Wu
6,774,866 B2 * 8/2004 McKinzie et al. ..... 343/909
6,822,622 B2 * 11/2004 Crawford et al. ..... 343/909
6,891,514 B1 5/2005 Henry et al.
2004/0100418 A1 * 5/2004 Best et al. ..... 343/909

* cited by examiner

*Primary Examiner*—Hoang V. Nguyen
(74) *Attorney, Agent, or Firm*—Dinsmore & Shohl LLP

(57) ABSTRACT

Antenna assemblies and corresponding modes of operation are provided where the first antenna assembly of the system is tuned to a first frequency band $\nu_1$ and the second antenna assembly of the antenna system is tuned to a second frequency band $\nu_2$. The ground plane of the first antenna assembly is configured as a frequency selective surface that is substantially reflective of radiation in the first frequency band and substantially transparent to radiation in the second frequency band. The second ground plane may also be configured as a frequency selective surface and may be reflective of radiation in the second frequency band.

28 Claims, 6 Drawing Sheets

MULTI-BAND ANTENNA

CROSS-REFERENCE TO RELATED APPLICATIONS

This application claims the benefit of U.S. Provisional Application Ser. Nos. 60/641,403 (OSU 0026 MA), filed Jan. 5, 2005, and 60/704,588 (OSU 0040 MA), filed Aug. 2, 2005.

STATEMENT REGARDING FEDERALLY SPONSORED RESEARCH OR DEVELOPMENT

This invention was made with government support under Small Business Innovation Research SPAWAR Contract Nos. N00039-03-C-0078 and N00039-04-C-0031. The Government has certain rights in this invention.

BACKGROUND OF THE INVENTION

The present invention relates to the design and operation of antennae capable of operating in multiple bands.

BRIEF SUMMARY OF THE INVENTION

According to the present invention, antenna assemblies and corresponding modes of operation are provided where the antenna system comprises at least two antenna assemblies. The first antenna assembly of the system is tuned to a first frequency band $\nu_1$ and comprises a first array of antenna elements, a first electrical ground plane electromagnetically coupled to the first array of antenna elements, and a first transmission network conductively coupled to the first array of antenna elements. The second antenna assembly of the antenna system is tuned to a second frequency band $\nu_2$ and comprises a second array of antenna elements, a second electrical ground plane electromagnetically coupled to the second array of antenna elements, and a second transmission network conductively coupled to the second array of antenna elements. The first ground plane is configured as a frequency selective surface that is substantially reflective of radiation in the first frequency band and substantially transparent to radiation in the second frequency band. The second ground plane may also be configured as a frequency selective surface and may be reflective of radiation in the second frequency band.

According to methods of operating antenna systems provided herein, respective fields of view defined by the respective antenna assemblies of the antenna system are oriented independently. The respective fields of view may be oriented such that a given antenna assembly partially obstructs the field of view of an additional antenna assembly within the system or where the degree to which one antenna assembly obstructs the field of view of the other varies, although it is noted that the present invention is not limited to embodiments where there is obstruction. Similarly, it is contemplated that the present invention is not limited to antenna systems where there is relative movement between the respective fields of view defined by the antenna assembly. For example, it is contemplated that embodiments of the present invention may be characterized by substantially complete, full-time obstruction of one antenna assembly by another antenna assembly.

Accordingly, it is an object of the present invention to provide improved antenna assemblies and corresponding modes of operation. Other objects of the present invention will be apparent in light of the description of the invention embodied herein.

BRIEF DESCRIPTION OF THE SEVERAL VIEWS OF THE DRAWINGS

The following detailed description of specific embodiments of the present invention can be best understood when read in conjunction with the following drawings, where like structure is indicated with like reference numerals and in which.

DETAILED DESCRIPTION

Figure 1:
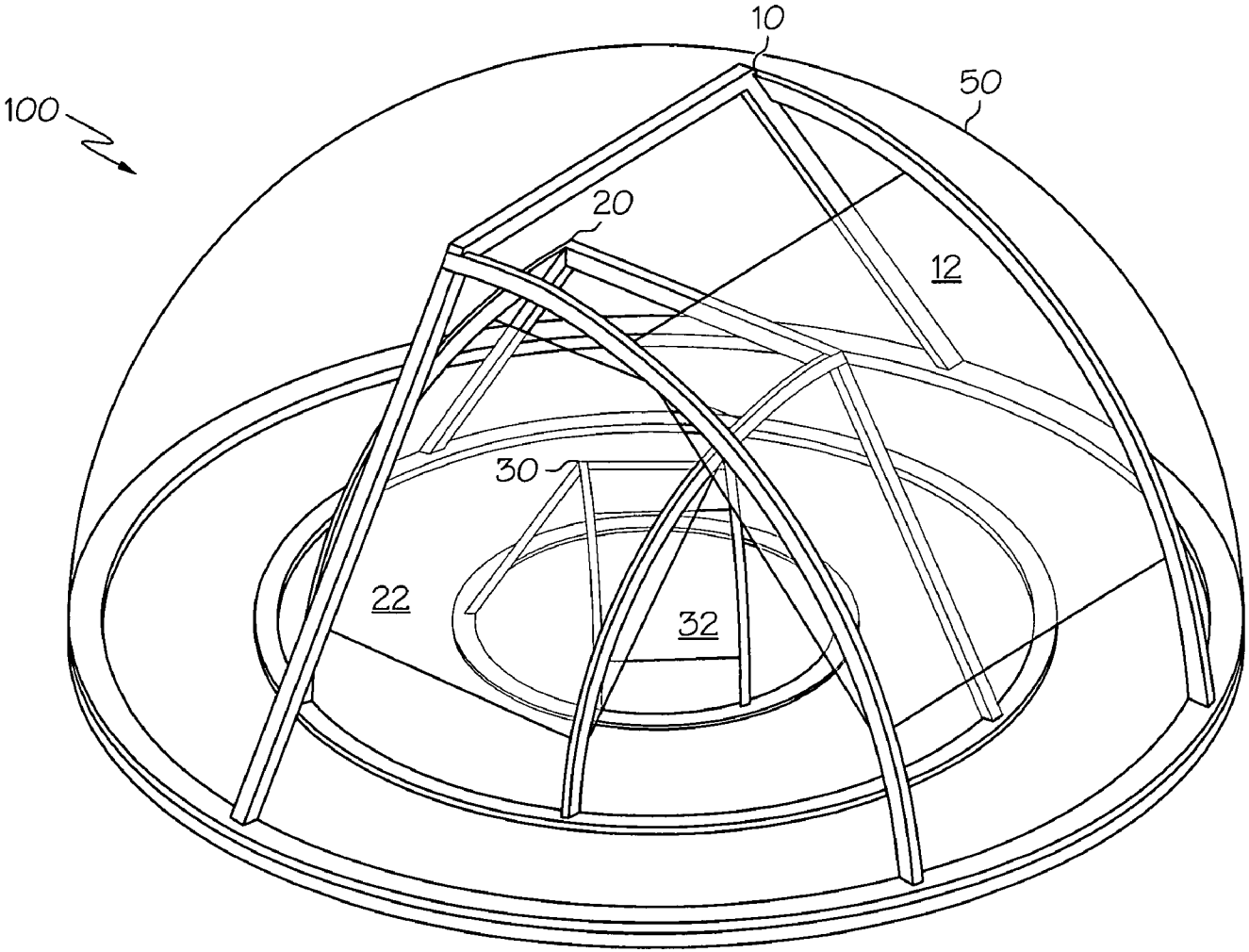
FIG. 1 is a general schematic illustration of an antenna layout according to one embodiment of the present invention.
Figure 2:
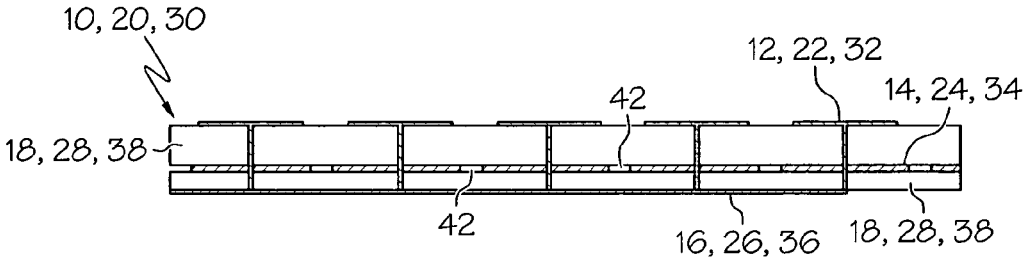
FIG. 2 is a cross-sectional view of a FSS-supported antenna array in accordance with one embodiment of the present invention.

Referring initially to FIG. 1, an antenna system 100 is provided comprising a plurality of independent antenna assemblies 10, 20, 30. Each antenna assembly 10, 20, 30 is tuned to a particular frequency band $\nu_1$, $\nu_2$, $\nu_3$ and comprises an array of antenna elements, an electrical ground plane, and a transmission network coupled to the array of antenna elements. More specifically, FIG. 2 illustrates the primary components of an antenna assembly 10, 20, 30 according to the present invention. The antenna assembly 10, 20, 30 and its components are identified in FIG. 2 using sets of reference numbers in the 10s, 20s, and 30s to signify that the illustrated structure will generally apply to the construction of any or all of the separate antenna assemblies 10, 20, 30 illustrated in FIG. 1.

Referring to FIG. 2, the assembly is configured such that an electrical ground plane 14, 24, 34 is electromagnetically coupled to an array of antenna elements 12, 22, 32 across a dielectric layer 18, 28, 38. A transmission network 16, 26, 36 is conductively coupled to each antenna element of the first array of antenna elements 12, 22, 32. The ground plane 14, 24, 34 is configured as a frequency selective surface that is substantially reflective of radiation in the frequency band to which the antenna elements are tuned and substantially transparent to radiation in frequency bands to which any underlying antenna assemblies are tuned. In this manner, a multi-band antenna system that can simultaneously receive and transmit in multiple bands can be constructed by consolidating a plurality of independent antenna assemblies 10, 20, 30 into a single multi-band antenna structure. More specifically, three independent antenna arrays, each designed for reception in a distinct band (e.g., the L, S, and X-bands), can be incorporated into a single antenna structure by providing ground planes 14, 24, 34 configured as frequency selective surfaces.

As is illustrated in FIG. 1, the antennas can be packaged with overlapping fields of view using a mechanical design that nests three independently positional antenna arrays 10, 20, 30 into a single package within a single radome 50. By configuring each antenna assembly 10, 20, 30 in the manner illustrated, the frequency tuning of each antenna assembly is not dependent upon any component or components of the other antenna assemblies in the system 100. Further, the operation of each antenna assembly 10, 20, 30 is substantially independent of the relative position of the other antenna assemblies within the system 100. As is illustrated schematically in FIG. 1, an antenna system 100 according to the present invention can be configured such that the first, second, and third antenna assemblies 10, 20, 30 define respective fields of view that can be oriented independently of each other through relative movement of the antenna assemblies within the radome 50 of the antenna system 100.

To optimize operation, the respective ground planes 14, 24, 34 of the first, second, and third antenna assemblies 10, 20, 30 can be configured as frequency selective surfaces that will be substantially reflective of radiation in the frequency band to which the particular antenna assembly is tuned and substantially transparent to radiation in the frequency bands of any underlying antenna assemblies. In this manner, the antenna system 100 can be configured such that the first antenna assembly 10 may be positioned to obstruct the field of view of the second antenna assembly 20 without substantially degrading the functionality of the second antenna assembly 20. Similarly, the first and second antenna assemblies 10, 20 may be positioned to obstruct the field of view of the third antenna assembly 30 without substantially degrading its performance. Further, the respective functionality of each antenna assembly 10, 20, 30 will be substantially entirely independent of the degree to which one antenna assembly obstructs the field of view of the others. In this manner, the operation of the antenna system as a whole will be largely unaffected by the relative positions of the antenna assemblies as they are moved within the radome 50.

For example, and not by way of limitation, according to one embodiment of the present invention, the first antenna assembly 10 can be configured as an L-Band antenna characterized by a first frequency band $\nu_1$ at least partially falling within the range of between about 0.39 GHz and about 1.75 GHz. The second antenna assembly 20 can be configured as an S-Band antenna characterized by a second frequency band $\nu_2$ at least partially falling within the range of between about 1.75 GHz and about 5.20 GHz. The third antenna assembly 30 can be configured as an X-Band antenna characterized by a third frequency band $\nu_3$ at least partially falling within the range of between about 5.20 GHz and about 10.9 GHz. More specifically, the first frequency band $\nu_1$ may extend from about 1.65 GHz and about 1.75 GHz, the second frequency band $\nu_2$ may extend from about 2.205 GHz to about 2.255 GHz, and the third frequency band $\nu_3$ may extend from about 7.45 GHz to about 7.85 GHz.

Figure 3A:
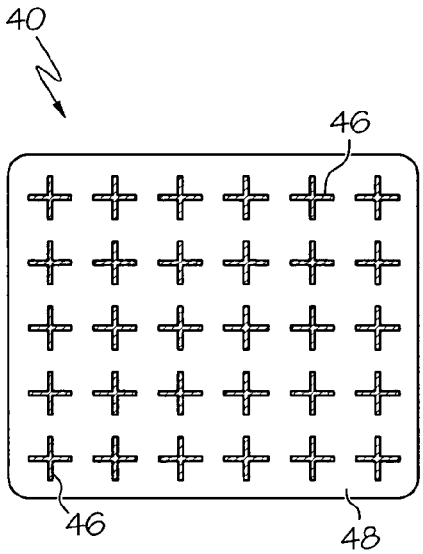
FIGS. 3A and 3B illustrate two different types of periodic surfaces for use in designing frequency selective surfaces for use in accordance with the present invention.
Figure 3B:
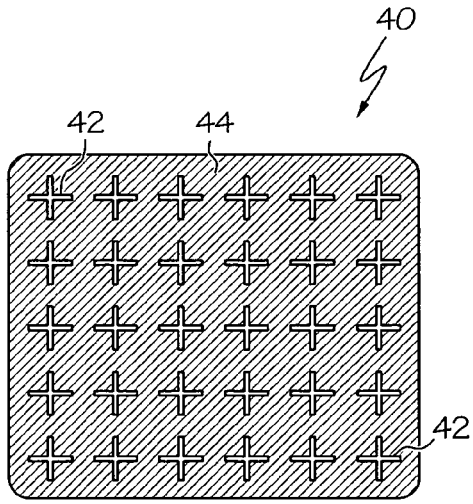

The frequency selective surfaces of each ground plane 14, 24, 34 can be arranged as a periodic, one or two-dimensional array of substantially identical ground plane elements. For example, referring to FIGS. 3A and 3B, the ground plane elements may comprise conductive patch elements 46 supported by a dielectric structure 48 or slot elements 42 formed in a conductive layer 44. Suitable reflection or transmission bands for each frequency selective surface can be established by choosing particular slot or patch element sizes and periodicities according to the well-established principles of frequency selective surface design. A number of generally suitable frequency selective surface configurations are described herein and should be taken as illustrative and non-limiting. For example, referring to FIG. 9, a frequency selective surface according to one embodiment of the present invention, comprises conductive patch elements 46 in the form of a wire-cross periodic surface supported by a dielectric structure.

Figure 4:
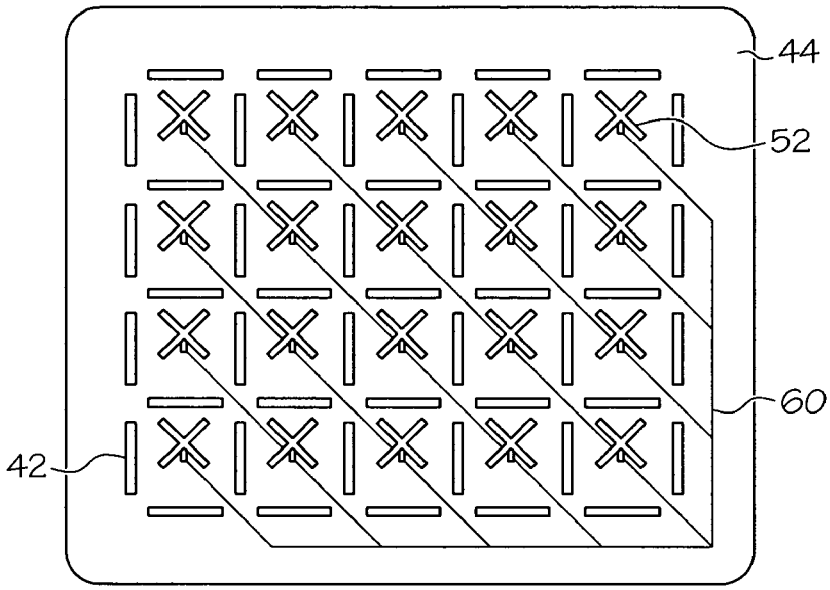
FIG. 4 is a plan view of a FSS-supported antenna array in accordance with one embodiment of the present invention.
Figure 9:
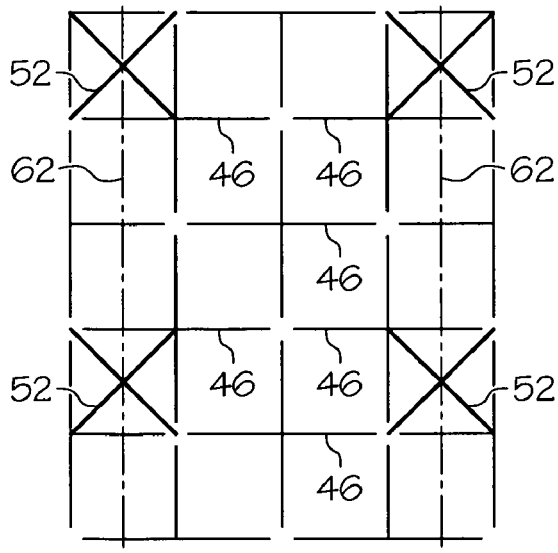
FIG. 9 is a plan view of a FSS-supported L-band antenna array in accordance with one embodiment of the present invention.

Referring collectively to the two different antenna assembly configurations illustrated in FIGS. 4 and 9, according to one aspect of the present invention, the frequency selective characteristics of antenna assemblies according to the present invention can be optimized by ensuring that the antenna elements 52 of the antenna array are positioned to avoid overlap with the ground plane elements 42, 46 of the frequency selective surface ground plane. Similarly, to avoid power leakage, the conductive lines 62 of the transmission network 60 can be configured to avoid overlap with the ground plane elements 42, 46. For the purposes of describing and defining the present invention, it is noted that the above-noted "overlap" is taken from a perspective along an orthogonal linear projection of a portion of a transmitted or received electromagnetic signal. For example, overlapping ground plane and antenna elements would both include portions that lie along a single linear projection of a portion of a transmitted or received electromagnetic signal, taken along a path generally orthogonal to the plane of the antenna assembly or, in the case of an antenna assembly with a curved surface profile, taken along a path generally orthogonal to a planar tangential surface of the antenna assembly.

As is illustrated in FIG. 2, antenna assemblies according to the present invention can be configured as a unitary multi-layer structure comprising, as multi-layer structural components, the array of antenna elements 12, 22, 32, the electrical ground plane 14, 24, 34, the transmission network 16, 26, 36, and one or more dielectric layers 18, 28, 38. This mode of construction is particularly advantageous because it provides a convenient means by which the dielectric gap spacing the ground plane 14, 24, 34 from the array of antenna elements 12, 22, 32 can be established. For example, in many instances it will be preferable to ensure effective grounding by setting the dielectric gap at less than the wavelength of the particular frequency band of interest. More preferable, the dielectric gap is set at about one-quarter of a wavelength of the frequency band of interest. The quarter wavelength spacing is typically chosen to let the ground plane become effective and allow in-phase addition of directly emitted and ground plane reflected waves.

Figure 5A:
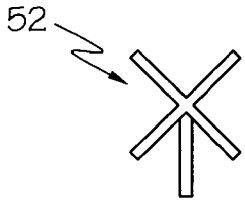
FIGS. 5A-5C illustrate a selection of suitable antenna elements according to the present invention.
Figure 5B:
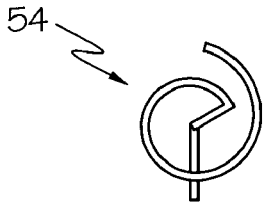
Figure 5C:
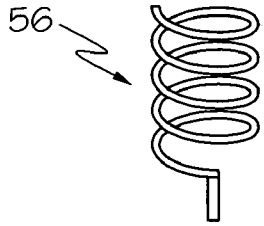
Figure 6:
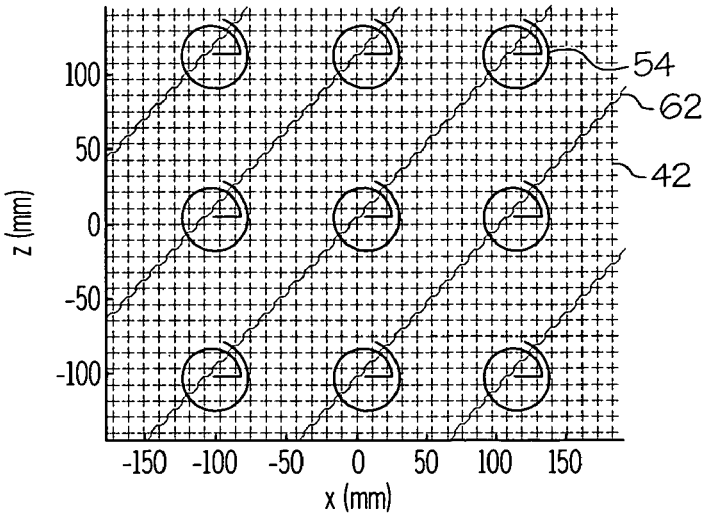
FIG. 6 a plan view of a FSS-supported S-band antenna array in accordance with one embodiment of the present invention.

Although the antenna elements of the antenna assemblies 10, 20, 30 according to the present invention may take a variety of forms, it is noted that suitable antenna element configurations include crossed dipole antenna elements 52 (see FIG. 5A), curl antenna elements 54 (see FIG. 5B), and helical antenna elements 56 (see FIG. 5C). It is noted that the cross dipole 52 and the curl 54 can be conveniently printed on a PC board. In addition, it is noted that particular embodiments of the present invention can employ bended dipole antenna elements 58 (see FIG. 11) or circular dipole antenna elements 59 (see FIG. 11). It is also noted that antenna elements suitable for use in accordance with the present invention may be selected such that the antenna assemblies support circular polarization, often required for satellite communication. Finally, according to one aspect of the present invention, antenna elements can be configured as rotatable curl antenna elements, where rotation of the antenna element about an axis orthogonal to the plane of the antenna array alters the phase of the transmitted or received signal. In this manner, the antenna assembly can be configured to provide uniform phase shift across the antenna array without the necessity of correcting for phase shift in the transmission line network of the array.

Although the transmission network of the antenna assemblies 10, 20, 30 according to the present invention may take a variety of forms, it is noted that suitable transmission network configurations may comprise a network of micro-strip or co-planar waveguide transmission lines configured to utilize the conductive layer of the ground plane as an electrical ground. Such a configuration is illustrated schematically in FIGS. 7 and 8. Alternatively, where the ground plane comprises an array of conductive patch elements supported by a dielectric structure, a suitable transmission network may comprises a co-axial cable network or a network of transmission lines implemented as components of a unitary multi-layered structure, similar to a printed circuit board, in the antenna assembly. Such a configuration is illustrated schematically in FIG. 9.

Figure 7:
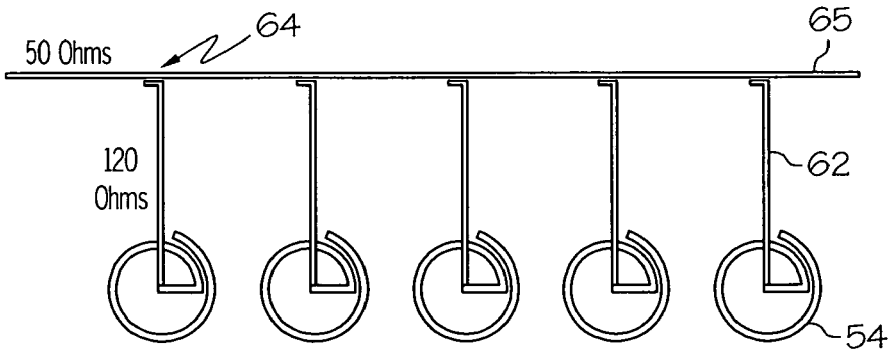
FIGS. 7 and 8 illustrate two alternative transmission line feed schemes for an S-band antenna array according to the present invention.

In the embodiment illustrated in FIG. 7, the transmission network 60 comprises directional couplers 64 through which individual elements 54 of the antenna array tap energy from a main feed line 65 of the network 60. The amount of energy coupled to the network of transmission lines can be controlled across the network 60 by controlling the length of the directional coupler and its spacing to the main line 65. By way of illustration, and not limitation, it is noted that the main feed line 65 is illustrated as a 50 ohm transmission line while the individual lines feeding each antenna element comprise 120 ohm lines.

Figure 8:
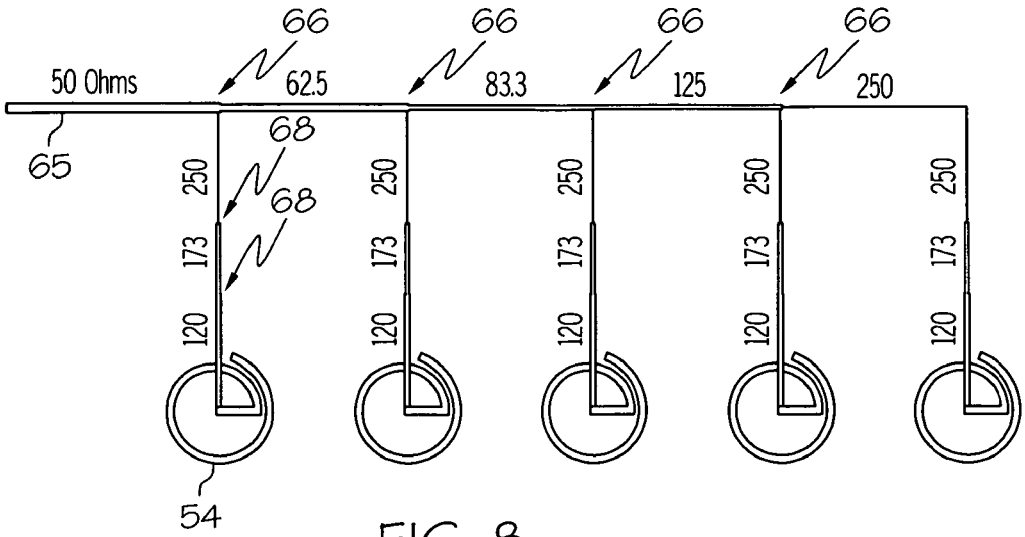

In the embodiment illustrated in FIG. 8, the transmission network 60 comprises T-junction power dividers 66 through which individual elements of the antenna array tap energy from the main feed line 65 of the network 60. The T-junction power dividers 66 are configured with varying degrees of power ratio division between the main feed line 65 and respective antenna elements 54 across the antenna element array. The first transmission network 60 may further comprise quarter wavelength transformers 68 through which individual elements 54 of the antenna array tap energy from the main feed line 65 of the network 60. As is illustrated in FIG. 8, the T-junction power dividers 66 can be used to properly distribute input energy and the quarter wavelength transformers can be configured to bridge impedance gaps of different sections of the antenna array. More specifically, by way of illustration and not limitation, in FIG. 8, step transitions in the transmission lines are used to match the 50 ohm main transmission line 65 to the 120 ohm antenna elements. The illustrated configuration starts with 50 ohms, splits 62.5/250 ohms, then splits 83.3/250 ohms, then splits 125/250 ohms and finally splits 250/250 ohms. The lines feeding each antenna element have transitions stepping from 250 ohms to 173 ohms to 120 ohms. In this manner, equal distribution of RF power to each antenna element is achieved. The configuration also results in impedance matching to each antenna element.

Figure 10A:
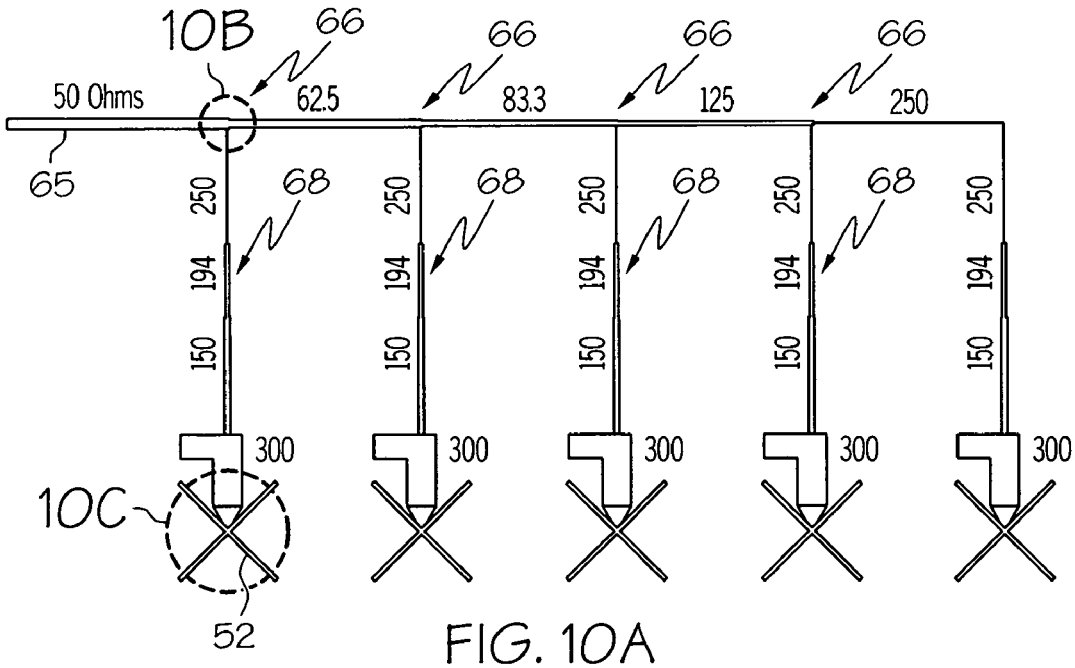
FIGS. 10A-10C and 11 illustrate alternative transmission line feed schemes for an L-band antenna array according to the present invention.
Figure 10B:
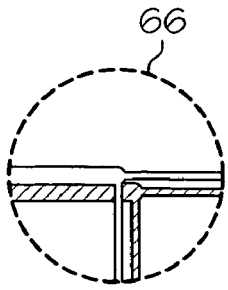
Figure 10C:
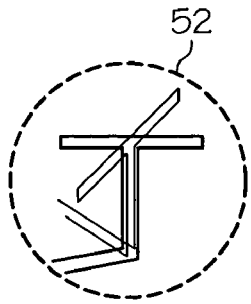

Referring to FIGS. 10A-C, a transmission network similar to the one illustrated in FIG. 8 is illustrated, with the exception that the micro-strip transmission line of the FIG. 8 embodiment is replaced by two-lead wires printed on the top and the bottom of the transmission line layer of a unitary multi-layer structure similar to a printed circuit board (see FIG. 10B). A power splitting scheme similar to that illustrated in FIG. 8 is shown in FIG. 10A. Specifically, the transmission lines have impedance jumps that yield power divisions matched to the needs of equal power to each radiating element. Furthermore, the curl element of FIG. 8 is replaced by two folded cross dipoles 52.

The folded dipole configuration of FIGS. 10A-C is used for its relatively high input impedance that avoids abrupt changes in transmission line characteristic impedance. The dipole antenna 52 is often more suitable where a balanced feed is ready from a two-lead main feed line 65. As is illustrated in FIG. 10C, a second set of dipoles can be provided to support cross-polarized waves. Specifically, referring to FIGS. 10A and 10C, the antenna element 52 comprises a 300 ohm folded dipole antenna element and a 300 ohm twin line transmission line. A 90-degree phase delay line, illustrated in FIG. 10A as a 300 ohm segment, can be added for the feed of the second dipole to yield circular polarization.

Figure 11:
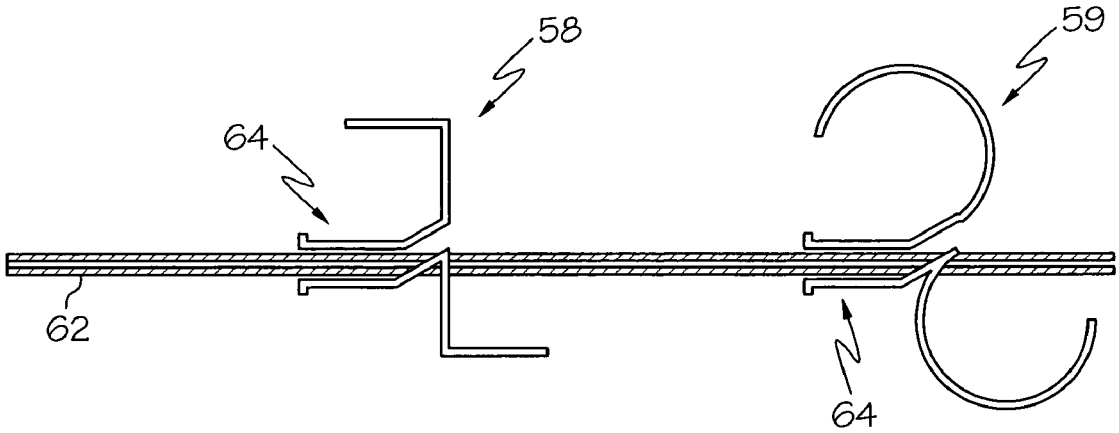

An alternative feed scheme and applicable radiation elements are illustrated in FIG. 11, where a co-planar stripline 62 is used with directional couplers 64 to tap energy from the main feed line and direct it to respective upright two-lead wires of a bended dipole antenna element 58. The bended dipoles 58 are designed to handle circular polarization through radiations from dipole segments of different orientations. Alternatively, it is contemplated that a circular dipole 59, illustrated in FIG. 1, can also be used to handle circular polarization.

Having described the invention in detail and by reference to specific embodiments thereof, it will be apparent that modifications and variations are possible without departing from the scope of the invention defined in the appended claims. For example, although the present invention is described in the context of antenna assemblies that overlap within a radome, this contextual description should not be taken as an implication that the present invention is limited to particular array geometries or to antenna systems where the antenna assemblies move relative to each other. It is contemplated that antenna arrays of the present invention may be configured as flat arrays, curved arrays, spherical section arrays, etc. and as arrays that move relative to each other or remain in a fixed "stack" of antenna arrays.

For the purposes of describing and defining the present invention, it is noted that an antenna is a device that is designed to transmit electromagnetic energy by converting electric signals propagating along a transmission line into electromagnetic waves, receive electromagnetic energy by converting electromagnetic waves into electric signals propagating along a transmission line, or transmit and receive electromagnetic energy.

It is noted that terms like "preferably," "commonly," and "typically" are not utilized herein to limit the scope of the claimed invention or to imply that certain features are critical, essential, or even important to the structure or function of the claimed invention. Rather, these terms are merely intended to highlight alternative or additional features that may or may not be utilized in a particular embodiment of the present invention. Furthermore, although some aspects of the present invention are identified herein as preferred or particularly advantageous, it is contemplated that the present invention is not necessarily limited to these preferred aspects of the invention.

For the purposes of describing and defining the present invention it is noted that the term "substantially" is utilized herein to represent the inherent degree of uncertainty that may be attributed to any quantitative comparison, value, measurement, or other representation. The term "substantially" is also utilized herein to represent the degree by which a quantitative representation may vary from a stated reference without resulting in a change in the basic function of the subject matter at issue.

What is claimed is:

1. An antenna system comprising at least two antenna assemblies, wherein:

a first antenna assembly of said antenna system is tuned to a first frequency band $\nu_1$ and comprises a first array of antenna elements, a first electrical ground plane electromagnetically coupled to said first array of antenna elements, and a first transmission network conductively coupled to said first array of antenna elements;

a second antenna assembly of said antenna system is tuned to a second frequency band $\nu_2$ and comprises a second array of antenna elements, a second electrical ground plane electromagnetically coupled to said second array of antenna elements, and a second transmission network conductively coupled to said second array of antenna elements; and said first ground plane is configured as a frequency selective surface that is substantially reflective of radiation in said first frequency band and substantially transparent to radiation in said second frequency band.

2. An antenna system as claimed in claim 1 wherein:

said frequency tuning of said first antenna assembly is substantially independent of the configuration of said antenna elements, said ground plane, and said transmission network of said second antenna assembly; and said frequency tuning of said second antenna assembly is substantially independent of the configuration of said antenna elements, said ground plane, and said transmission network of said first antenna assembly.

3. An antenna system as claimed in claim 1 wherein:

said frequency tuning of said first antenna assembly is substantially independent of the position of said second antenna assembly; and said frequency tuning of said second antenna assembly is substantially independent of the position of said first antenna assembly.

4. An antenna system as claimed in claim 1 wherein:

said antenna system comprises at least one additional antenna assembly;

said additional antenna assembly of said antenna system is tuned to an additional frequency band $\nu_3$ and comprises an additional array of antenna elements, an additional electrical ground plane electromagnetically coupled to said additional array of antenna elements, and an additional transmission network conductively coupled to said additional array of antenna elements;

said additional electrical ground plane is spaced from said additional array of antenna elements by a dielectric gap that is less than a wavelength of said additional frequency band $\nu_3$;

said first ground plane is configured as a frequency selective surface that is substantially transparent to radiation in said additional frequency band; and said second ground plane is configured as a frequency selective surface that is substantially reflective of radiation in said second frequency band and substantially transparent to radiation in said additional frequency band.

5. An antenna system as claimed in claim 4 wherein said additional ground plane is configured to be substantially reflective of radiation in said additional frequency band.

6. An antenna system as claimed in claim 1 wherein said frequency selective surface of said first ground plane is arranged as a periodic, one or two dimensional array of substantially identical ground plane elements.

7. An antenna system as claimed in claim 6 wherein said substantially identical ground plane elements comprise slot elements formed in a conductive layer or conductive patch elements supported by a dielectric structure.

8. An antenna system as claimed in claim 6 wherein said array of substantially identical ground plane elements of said first ground plane is configured such that said antenna elements of said first array of antenna elements are positioned to avoid overlap with said ground plane elements of said first ground plane.

9. An antenna system as claimed in claim 8 wherein conductive lines of said first transmission network are further configured to avoid overlap with said array of substantially identical ground plane elements.

10. An antenna system as claimed in claim 1 wherein said second ground plane is configured as a frequency selective surface that is substantially reflective of radiation in said second frequency band.

11. An antenna system as claimed in claim 1 wherein said second ground plane is configured as a frequency selective surface that is substantially reflective of radiation in said second frequency band and substantially transparent to radiation in a third frequency band.

12. An antenna system as claimed in claim 1 wherein said antenna system is configured such that said first and second antenna assemblies define respective fields of view that can be oriented independently of each other through movement of at least one of said antenna assemblies within said antenna system.

13. An antenna system as claimed in claim 1 wherein said first and second antenna assemblies are configured as a unitary multi-layered structure comprising, as multi-layer components, said array of antenna elements, said electrical ground plane, said transmission network, and one or more dielectric layers.

14. An antenna system as claimed in claim 1 wherein said dielectric gap spacing said first electrical ground plane from said first array of antenna elements is about one-quarter of a wavelength of said first frequency band $\nu_1$.

15. An antenna system as claimed in claim 1 wherein said dielectric gap spacing said second electrical ground plane from said second array of antenna elements is about one-quarter of a wavelength of said second frequency band $\nu_2$.

16. An antenna system as claimed in claim 1 wherein:

said first electrical ground plane is spaced from said first array of antenna elements by a dielectric gap that is less than a wavelength of said first frequency band $\nu_1$; and said second electrical ground plane is spaced from said second array of antenna elements by a dielectric gap that is less than a wavelength of said second frequency band $\nu_1$.

17. An antenna system as claimed in claim 1 wherein antenna elements of said first antenna assembly, said second antenna assembly, or both, comprise antenna elements that are rotatable about a phase control axis orthogonal to the plane of the antenna array.

18. An antenna system as claimed in claim 1 wherein:

said first ground plane comprises an array of slot elements formed in a conductive layer; and said first transmission network comprises a network of micro-strip or co-planar waveguide transmission lines configured to utilize said conductive layer of said first ground plane as an electrical ground.

19. An antenna system as claimed in claim 1 wherein:

said first ground plane comprises an array of conductive patch elements supported by a dielectric structure; and said first transmission network comprises a co-axial cable network or a network of transmission lines implemented as components of a unitary multi-layer structure in said first antenna assembly.

20. An antenna system as claimed in claim 1 wherein said first transmission network, said second transmission network, or both, comprise directional couplers through which individual elements of said antenna arrays tap energy from a main feed line of said network.

21. An antenna system as claimed in claim 20 wherein said directional couplers are configured with varying degrees of energy coupling between said main feed line and respective antenna elements across said antenna element arrays.

22. An antenna system as claimed in claim 1 wherein said first transmission network, said second transmission network, or both, comprise T-junction power dividers through which individual elements of said antenna arrays tap energy from a main feed line of said network.

23. An antenna system as claimed in claim 22 wherein said T-junction power dividers are configured with varying degrees of power ratio division between said main feed line and respective antenna elements across said antenna element arrays.

24. An antenna system as claimed in claim 23 wherein said first transmission network, said second transmission network, or both, comprise quarter wavelength transformers through which individual elements of said antenna arrays tap energy from said main feed line of said network.

25. An antenna system as claimed in claim 1 wherein said antenna system is configured such that said first antenna assembly is positioned to at least partially obstruct a field of view defined by said second antenna assembly.

26. An antenna system as claimed in claim 25 wherein said first and second antenna assemblies are configured such that the functionality of said second antenna assembly is substantially independent of the degree to which said first antenna assembly obstructs the field of view defined by said second antenna assembly.

27. An antenna system as claimed in claim 25 wherein said antenna system further comprises an additional antenna assembly and said first and second antenna assemblies are positioned to at least partially obstruct a field of view defined by said additional antenna assembly.

28. A method of operating an antenna system comprising at least two antenna assemblies, wherein:

a first antenna assembly of said antenna system is tuned to a first frequency band $\nu_1$ and comprises a first array of antenna elements, a first electrical ground plane electromagnetically coupled to said first array of antenna elements, and a first transmission network conductively coupled to said first array of antenna elements;

a second antenna assembly of said antenna system is tuned to a second frequency band $\nu_2$ and comprises a second array of antenna elements, a second electrical ground plane electromagnetically coupled to said second array of antenna elements, and a second transmission network conductively coupled to said second array of antenna elements;

said first ground plane is configured as a frequency selective surface that is substantially reflective of radiation in said first frequency band and substantially transparent to radiation in said second frequency band; and said method comprises orienting respective fields of view defined by said first and second antenna assemblies independently such that such that said first antenna assembly is positioned such that the degree to which said first antenna assembly obstructs the field of view defined by said second antenna assembly varies as said respective fields of view are oriented independently of each other.

* * * * *

UNITED STATES PATENT AND TRADEMARK OFFICE

CERTIFICATE OF CORRECTION

PATENT NO. : 7,239,291 B2
APPLICATION NO. : 11/325365
DATED : July 3, 2007
INVENTOR(S) : Eric Walton It is certified that error appears in the above-identified patent and that said Letters Patent is hereby corrected as shown below:

Col. 6, line 25, "Fig 1" should read -- Fig. 11, --

Signed and Sealed this

Fifteenth Day of April, 2008

JON W. DUDAS
*Director of the United States Patent and Trademark Office*